US005279209A

United States Patent [19]

Mayne

[11] Patent Number: 5,279,209

[45] Date of Patent: Jan. 18, 1994

[54] ROTARY MACHINE

[75] Inventor: Alfred R. Mayne, Parkwood, Australia

[73] Assignee: Split Cycle Technology, Ltd., Queensland, Australia

[21] Appl. No.: 946,457

[22] PCT Filed: May 22, 1991

[86] PCT No.: PCT/AU91/00224

§ 371 Date: Nov. 13, 1992

§ 102(e) Date: Nov. 13, 1992

[87] PCT Pub. No.: WO91/18188

PCT Pub. Date: Nov. 28, 1991

[30] Foreign Application Priority Data

May 22, 1990 [AU] Australia ..... PK 0267

[51] Int. Cl.[5] ..... F01B 9/00

[52] U.S. Cl. ..... 92/140; 74/129; 74/143; 475/14; 123/197.1; 92/148

[58] Field of Search ..... 92/72, 140, 148; 74/128, 129 X, 142, 143 X; 475/14 X; 123/197.1 X

[56] References Cited

U.S. PATENT DOCUMENTS

| | | | |
|---|---|---|---|
| 1,777,179 | 9/1930 | Perlman | 123/197.1 |
| 2,417,649 | 3/1947 | Johansen et al. | 123/197.1 |
| 2,779,201 | 1/1957 | Hurley | 74/129 |
| 3,433,172 | 3/1969 | Sola | 92/140 |

FOREIGN PATENT DOCUMENTS

| | | | |
|---|---|---|---|
| 3-189447 | 8/1991 | Japan | 74/129 |

*Primary Examiner*—Thomas E. Denion

*Attorney, Agent, or Firm*—Brumbaugh, Graves, Donohue & Raymond

[57] ABSTRACT

A machine that converts between reciprocating motion of a piston and rotary motion of a shaft. The shaft rotates an integral web that carries a number of lobe wheels spaced evenly about a pitch circle centered on the shaft. The lobe wheels are planetary driven by pinions and a fixed ring gear. The lobe wheels are somewhat star shaped with radially extending lobes which push followers outwardly, then release them inwardly, as the lobe wheels orbit past and below the follower. The follower is connected by a lever and a pair of connecting rods and to the piston.

14 Claims, 6 Drawing Sheets

ROTARY MACHINE

FIELD OF THE INVENTION

This invention relates to linear to rotary motion conversion in machines such as reciprocating piston internal combustion engines and fluid pumps.

Commonly linear to rotary motion conversion in machines is carried out by a crank and connecting rod. Notwithstanding the many disadvantages of this mechanism, well known in the art, it is still the most accepted mechanism for obtaining this effect.

BRIEF DESCRIPTION OF THE PRIOR ART

International patent application PCT/AU89/00275, by the present applicant, describes a single bank radial reciprocating piston machine with a central rotating shaft, the reciprocating piston to rotary shaft connection being by way of a number of planetary lobe shafts. Each lobe shaft rotates about an axis orbiting about the central axis and each including a planet gear engaging an internal ring gear to effect their rotation proportional to their orbital rotation. Each lobe shaft further includes a number of equally angularly spaced apart lobes which, during rotation of the machine, consecutively engage consecutive pistons about the machine's circumference.

Although such prior art machine works effectively, the present invention may be considered as a viable alternative.

SUMMARY OF THE INVENTION

Accordingly, in one broad form, the present invention may be said to consist in a machine having:

a central axis;

a plurality of lobe wheels each being rotational about is own axis and orbital about a common circular path centered on the central axis and each having a plurality of equally spaced apart radially extending lobes;

a fixed internal ring gear centered on the central axis;

a respective pinion gear driving each respective lobe wheel and engaging the ring gear, and the pinion gears all having an equal number of gear teeth;

at least one reciprocating piston slidable within a respective cylinder;

a radially reciprocable lobe follower for each piston; and a respective lever arm pivotable about one fixed end and connected positively between each piston and its respective lobe follower so as to provide proportional synchronous reciprocation of the piston and the follower, and the number of lobes per lobe wheel and pinion to ring gear ratio being selected in combination such that at spaced apart radial axes consecutive passing lobe wheels have a lobe which is at a maximum radial distance from the central axis and each follower is positioned aligned with a respective said radial axis.

Preferably each lever arm is connected to its respective piston by a connecting rod, and is connected to its respective follower by another connecting rod.

Preferably the lobe follower is constrained to follow the successive lobes in the outward direction by engagement of the successive lobes with a radially inner under side of the lobe follower, and constrained to follow the lobe in the radially inward direction by engagement with a cam ring rotating at the orbital speed of the lobe wheels and including an interior cam surface.

Preferably each lobe wheel and respective pinion gear are rigidly connected by a lobe shaft journalled in a radial web rotating about the central axis.

Preferably the pistons comprise a plurality of pistons arranged in two radial banks and the lever arms are arranged in pairs with each lever arm pivoting at one end being approximately centrally intermediate the two banks of pistons.

BRIEF DESCRIPTION OF THE DRAWINGS

By way of example only a preferred embodiment of the invention will now be described with reference to the accompanying drawings, in which.

DESCRIPTION OF THE PREFERRED EMBODIMENT

Figure 1:
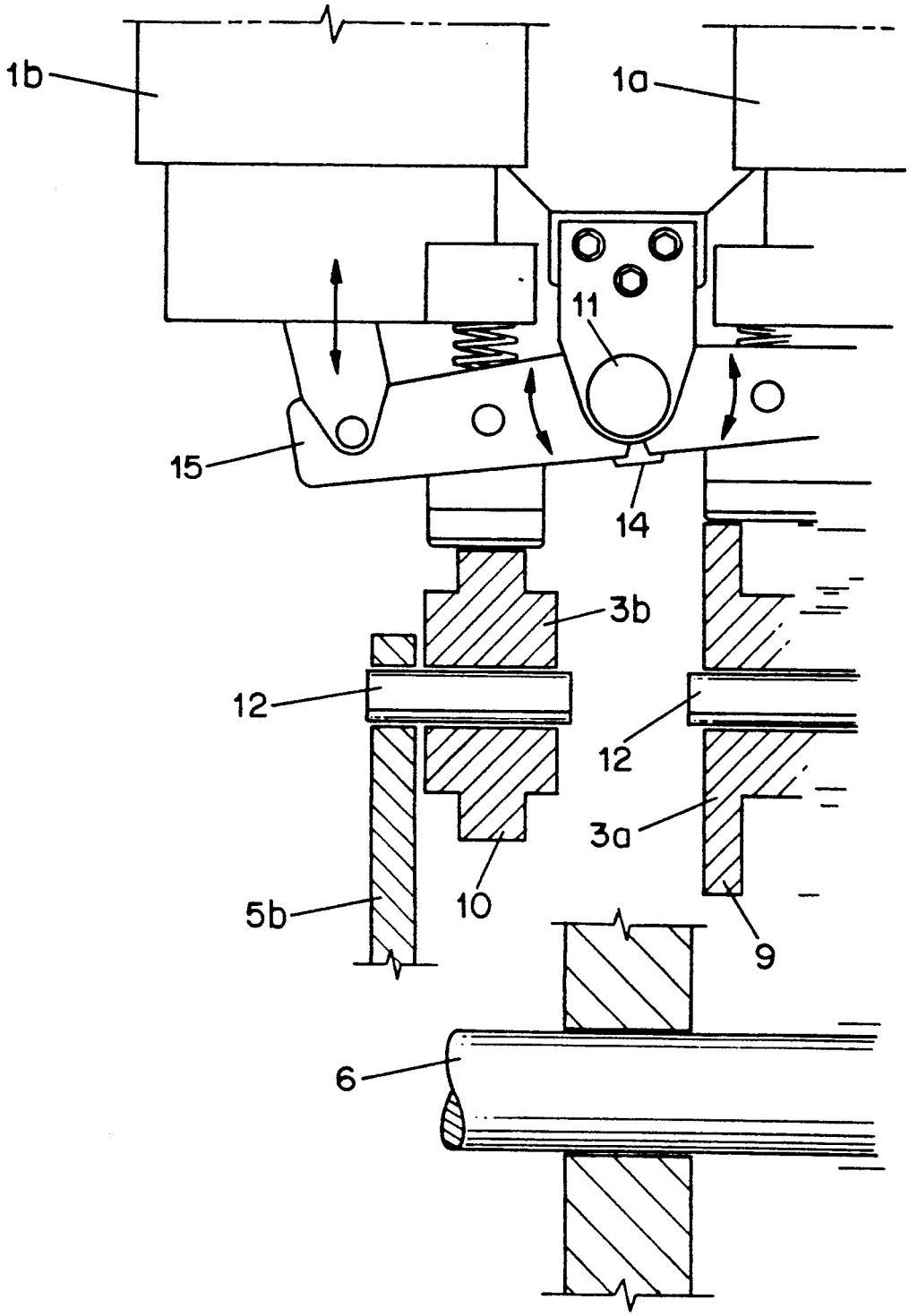
FIG. 1 is a longitudinal sectional sketch of an embodiment of the invention.

The machine has a rotating central shaft 6 and a double bank, a, b, of radial pistons 1 centred about the shaft 6. The whole machine is not shown in the drawings but the general arrangement should be clear from FIGS. 1 and 2.

Each piston 1*a* has an adjacent cooperative piston 1*b* from the second bank of pistons. Interconnected between cooperative pairs of pistons 1*a*, 1*b* is a rocker arm 2 pivoted on a tangential pin 11. In use the pistons 1*a*, 1*b* of each cooperative pair reciprocate asyncronously in constant contact with their respective end of the rocker 2.

The rocker 2 is not rigid but is articulated at its centre so that its two halves have a limited angle of movement which, however, is heavily biassed by a cushion device 14.

Figure 5:
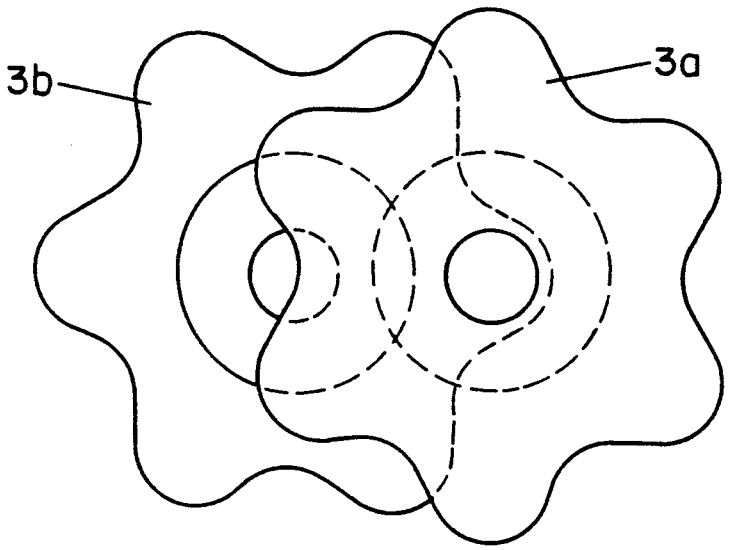
FIG. 5 is a sketch of still further components of the device of the FIGS. 1 and 2.

Integral with the main central shaft 6 are a pair of radial webs 5*a* and 5*b* disposed symmetrically about the central diametric plane containing the pins 11. Toward the outer edge of each web 5 are carried a plurality of pins 12 which each carry a lobed shaft 3 arranged equally spaced about a common pitch circle. The lobed shafts 3 are themselves arranged in two banks a, b, and reside in pairs one either side of the rocker pin 11 and each contacting the underside of the associated rocker 2 at a region defining a lobe follower. The lobe follower regions effectively reciprocate radially in response to action by consecutive lobes. FIG. 5 is an end view of such a pair of lobed shafts 3*a*, 3*b* showing that they are each of six lobes 9, 10 and arranged asymmetrically. Thus during rotation of the lobed shafts 3 the lobes 9, 10 of one of the shafts, say 3*a*, will be raising the respective side of the rocker 2 while the lobe of the other shaft, 3*b*, will be allowing its respective side of the rocker 2 to sink. The profiles of the lobes 9, 10 are such that the rise and fall motion is not symmetrical but this is counteracted by the biased, articulated rocker 2 maintaining continuous contact.

Figure 2:
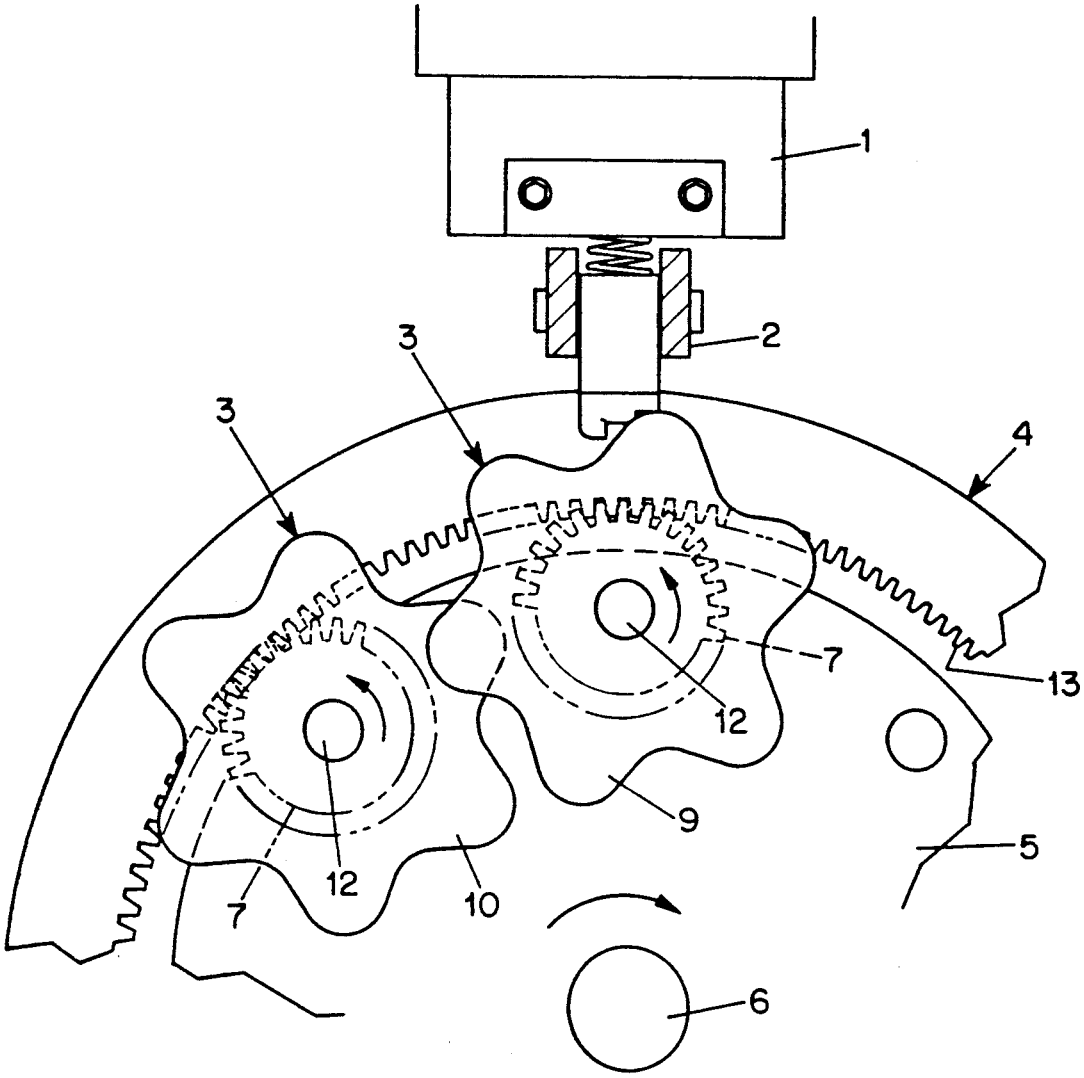
FIG. 2 is a transverse sectional sketch of a portion of the device of FIG. 1.

The lobed shafts 3 move in a planetary manner by rotation of the webs 5 and by the engagement of the gears 7, integral with each lobed shaft 3, and the stationery 30 ring gear 13 cast into the machine casing. FIG. 2 shows the various rotary motion arrows indicating the relative directions of rotation of these components.

Figure 3:
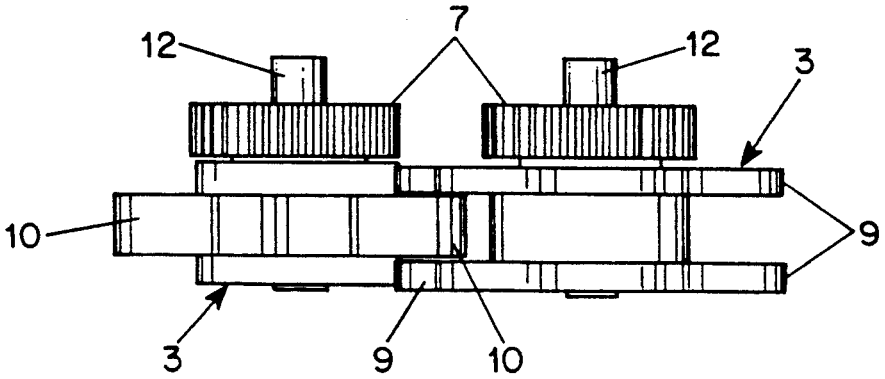
FIG. 3 is a sketch of, in part, two cooperate components of the device of FIGS. 1 and 2.
Figure 4:
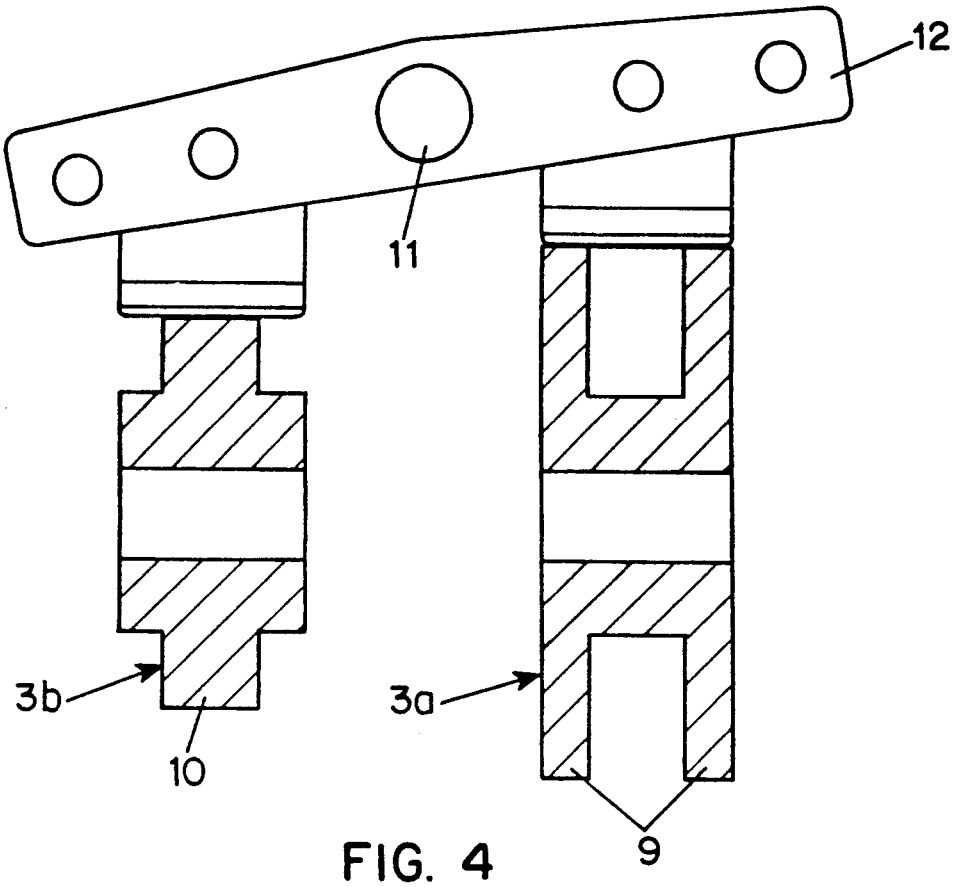
FIG. 4 is a sketch of further components of the device of FIGS. 1 and 2.

FIG. 3 shows how adjacent lobed shafts 3, forming a part of a common bank, a or b, overlap in a tongue and groove type arrangement. Each lobed shaft 3 includes six lobes being either grooved female lobes 9 or tongued male lobes 10. The lobed shafts 3 are positioned and timed such that their outermost radial points overlap as they pass freely by each other in a tongue and groove arrangement. Also, they are positioned and timed so that at predetermined radial axes, C—C, with which the lobe follower regions of rockers 2 are aligned, each passing lobed shaft 3 has a lobe 9, 10 at its maximum radial extent.

The pistons 1 are maintained in continuous contact with their respective end portions of the rockers 2 by any convenient mechanical or fluid mechanism, such a fluid mechanism being described in the beforehand referenced patent application PCT/AU89/00275 or by a slotted direct couple 15 shown in the drawings. Also, the operation of each piston 1 can be in accordance with established technology, i.e. a conventional internal combustion piston within a cooperative cylinder, a positive displacement fluid pump, or the like.

Figure 6:
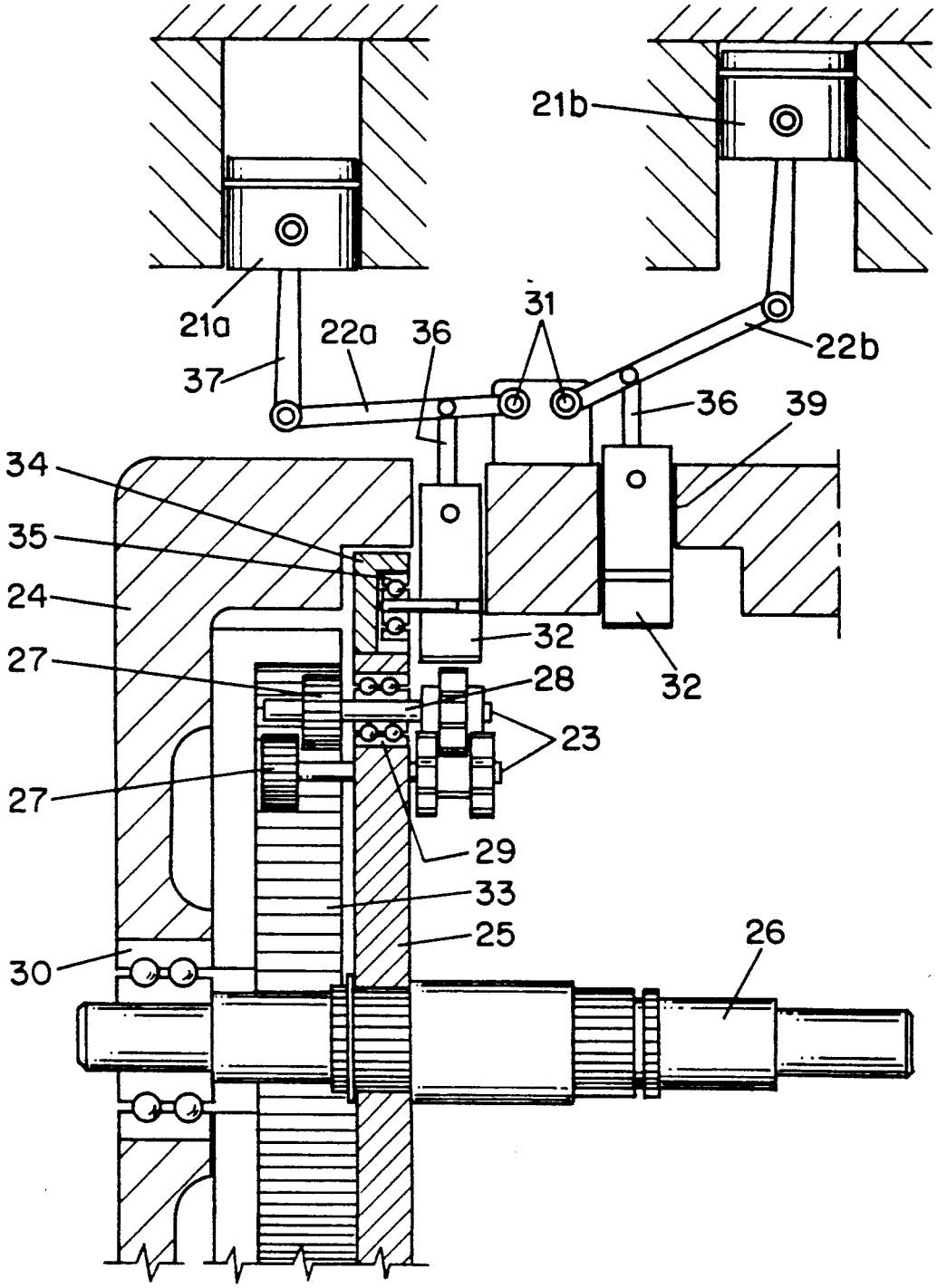
FIG. 6 is a view similar to that of FIG. 1 showing an alternative embodiment of the invention.
Figure 7:
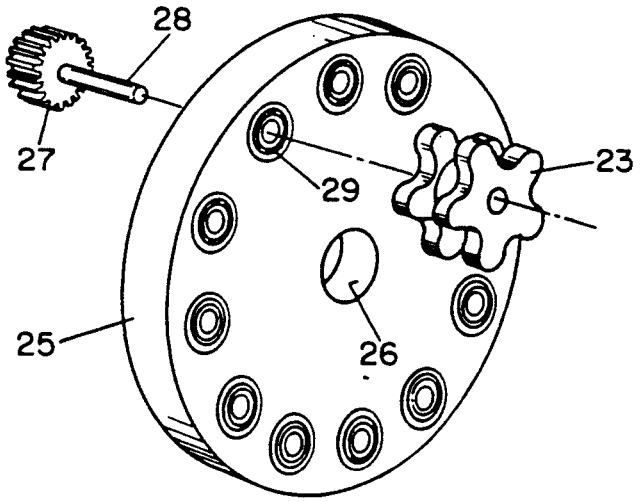
FIGS. 7–9 show in detail respective sub-assemblies of the device of FIG. 6.

An alternative embodiment of the invention is shown in FIG. 6. This embodiment includes a similar arrangement of two radial banks of pistons 21, the banks of pistons being designated 21*a* and 21*b*.

Each piston 21 is connected by a radially outer connecting rod 37 to a respective lever arm 22. The connecting rods 37 pivot at both the piston 21 end and the lever arm 22 end. The lever arms 22 pivot at inboard pins 37 which run tangentially of shaft 26 and are ridgidly fixed relative to the engine case 24.

A radially inner connecting rod 36 connects each lever arm 22 to a respective cam lobe follower 32 in a similar pivoting manner. Each follower 32 slides generally radially and reciprocatingly within a guide 39 fixed relative to the engine case 24. The followers 32 are positioned on engine radiuses which correspond to the orbiting angles at which lobes reach their maximum outward radial extent, such as shown in FIG. 2 in respect of the embodiment described earlier in this specification.

The lobe shaft assemblies comprise an integral shaft 28 and pinion gear 27 which passes through a bearing 29 within the rotating web 25. A lobe wheel 23 is fixed on the end of the shaft 28 opposite to the pinion gear 27, by a key or similar positive engaging device.

Figure 8:
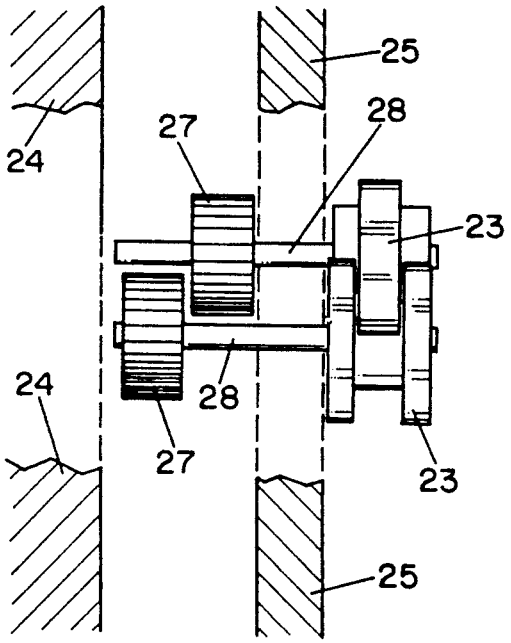

FIG. 8 shows detail of the lobe wheel assemblies indicating two separate assembly designs in which every second circumferentially sequenced lobe wheel 23 is either a straight lobe wheel or a heavily circumferentially grooved lobe wheel which allows a mating overlap of adjacent lobe wheel 23 as shown. Adjacent overlapping pinion gears 27 are catered for by virtue of their offset along the longitudinal extent of their respective shaft 28, also shown in FIG. 8.

As with the embodiment of FIG. 1 each lobe wheel 27 engages a ring gear 33 which is fixed relative to the engine case 24. The web 25 rotates ridgedly with the main shaft 26, which runs in bearings 30 within the case 24.

The interaction of the lobe wheels 23 and the followers 32 is substantially the same as that previously described with reference to FIGS. 1-5 in relation to the lobe wheels 3 contacting the underside of the rocker arm 2. However in the case of the device FIG. 6, the followers can move perfectly linearly, rather than along a small arc of a circle, and a purely rolling contact can be obtained between the lobe wheels 23 and the followers 32, that is, contact without any sliding motion.

Figure 9:
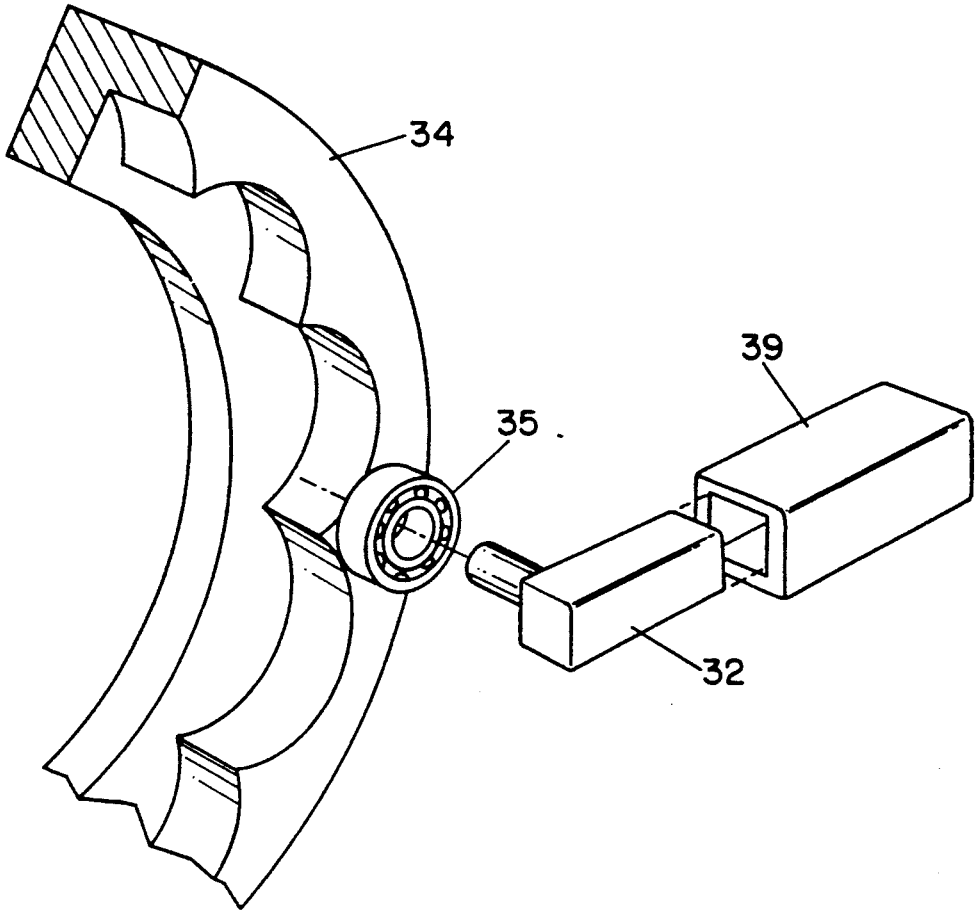

Further detail of the follower 32, and related components, is shown in FIG. 9. The follower 32 is of square or similar cross-section so as to constrain it from rotation about its longitudinal axis. The guide 39 is of a corresponding internal shape. Extending from a portion of the follower 32, which portion is always external of the guide 39, is a suitable attachment such as a pin which carries a bearing 35. The bearing 35 followers within a ring cam 34 which is shaped so as to correspond to the normal movement of the follower 32 under the influence of the lobe wheels 23. This arrangement ensures a positive return of the follower 32, and the linkages extending up to the piston 21, whenever working conditions within the cylinder to piston 21 do not themselves ensure positive instantaneous piston return.

The profile of the tip of each lobe of each cam wheel 23 is identical and relates to the underside contact surface of the lobe followers 32, and to the complex path followed by the lobes, so that contact between the lobes and the lobe followers 32 is of a purely rolling character, similar to that obtained in hypoid gears.

Furthermore, the basic arrangement provides a non-symmetrical reciprocating motion of the pistons 21 relative to the rotational speed of the shaft 26. Taking into consideration a radially outer half of the reciprocating motion of a piston 21, and the corresponding radially inner half of the reciprocation, at constant rotational speed of shaft 26, the average speed of piston 21 in the radially outer half of the cycle is higher than that during the radially inner half of the cycle. The actual amount of "non-symmetry" can be altered, at least to a degree, by design factors such as the tip profile of the lobes of the lobe wheels 23, the shape of the underside contacting surface of the lobe followers 32, 30 dwell time between the disengagement of one lobe and the engagement of the next consecutive lobe with the lobe followers 32, and other primarily geometrical relationships.

FIG. 8 shows, in the generally radial direction, how two adjacent lobe wheel sub-assemblies 23, 27, 28, overlap.

Figure 10:
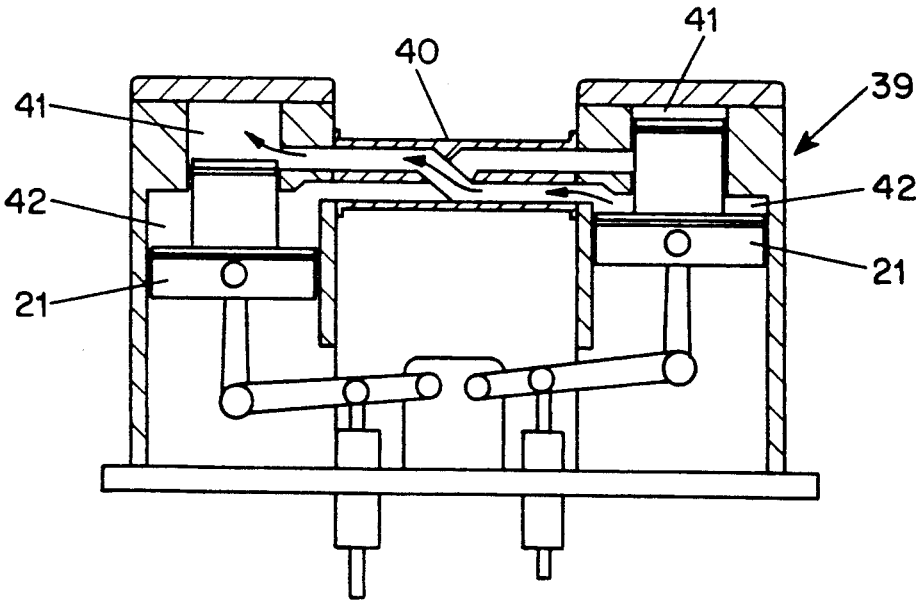

FIG. 10 shows in cross section a cartridge 39 of an internal combustion engine which houses a pair of pistons 21. The cartridge 39 is easily installed or removed from the machine. The pistons 21 shown in FIG. 10 are of a stepped construction providing two separate working volumes or chambers 41 and 42. In operation the radially inner chamber 42 is used to precompress, or supercharge, a combustible air and fuel mixture which is then transferred via a cross over port 40 to the radially outer working chamber 21, forming the combustion chamber, of the other piston 21 of the pair where it will undergo further compression. This is useful for example in a stepped piston internal combustion engine, the concepts of which are well understood in the prior art.

Figure 11:
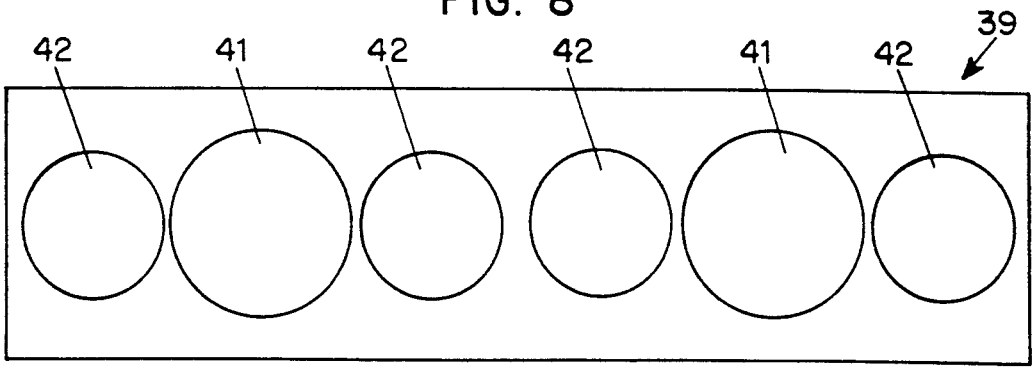
FIGS. 10 and 11 show alternative components for use in the devices of FIGS. 1 and 6.

FIG. 11 shows a second cartridge 39 which includes 6 separate working chambers arranged in pairs of triple chambers. Each triple chamber comprising a centre chamber 41, corresponding to the radially outer chamber 41 of FIG. 10, and two chambers 42 corresponding to the radially inner chambers 42 of FIG. 10. Similar cross over porting is provided but not shown between chambers 42 and 41 of adjacent pairs.

I claim:

1. A machine having:

a central axis;

a plurality of lobe wheels each being rotational about its own axis and orbital about a common circular path centred on the central axis and each having a plurality of equally spaced apart radially extending lobes;

a fixed internal ring gear centered on the central axis;

a respective pinion gear driving each respective lobe wheel and engaging the ring gear, and the pinion gears all having an equal number of gear teeth;

at least one reciprocating piston slidable within a respective cylinder; and a radially reciprocable lobe follower for each piston; and a respective lever arm pivotable about one fixed end and connected positively between each piston and its respective lobe follower so as to provide proportional synchronous reciprocation of the piston and the follower, the number of lobes per lobe wheel and pinion to ring gear ratio being selected in combination such that at spaced apart radial axes consecutive passing lobe wheels have a lobe which is at a maximum radial distance from the central axis and each follower is positioned aligned with a respective said radial axis.

2. A machine of claim 1 wherein each lever arm is connected to its respective piston by a connecting rod, and is connected to its respective follower by another connecting rod.

3. A machine of claim 2 characterized in that the follower is constrained to follow the consecutive lobes in the outward direction by engagement of the consecutive lobes with a radially inner underside of the lobe follower, and constrained to follow the consecutive lobes in the radially inward direction by engagement with a cam ring rotating at the orbital speed of the lobe wheels and including an interior cam surface.

4. A machine of claim 3 wherein a rolling contact occurs between each follower and each successive lobe.

5. A machine of claim 4 wherein each lobe is non-symmetrical.

6. A machine of claim 4 wherein each follower includes a radially inner surface which contacts successive lobes and which is non-planar.

7. A machine of claim 4 further characterised by each lobe wheel and respective pinion being rigidly connected by a respective lobe shaft, the lobe shafts being journalled in, and equally spaced about, a radial web rigid of a central main shaft.

8. A machine of claim 4 further characterised in that lobe wheels adjacent in their orbital path overlap so that each lobe disengages a particular lobe follower approximately as the next successive lobe engages said particular lobe follower.

9. A machine of claim 7 further characterised in that lobe wheels adjacent in their orbital path overlap so that each lobe disengages a particular lobe follower approximately as the next successive lobe engages said particular lobe follower.

10. A machine of claim 9 characterised by having a plurality of pistons arranged radially, equally angularly spaced apart about a common pitch circle and within a common piston radial plane, and by having a plurality of followers, each follower associated with a respective piston, and each follower being arranged radially, equally angularly spaced apart about a common pitch circle and within a common follower radial plane.

11. A machine of claim 10 characterised by including two closely axially spaced apart follower radial planes and two axially spaced apart piston radial planes, said two follower radial planes being intermediate said two piston radial planes, said pistons comprising pairs of pistons, one of each pair residing in one of each piston radial plane and being in a common axial plane.

12. A machine of claim 11 wherein the pistons of each pair reside in a common cartridge separable from the machine as a whole.

13. A machine of claim 11 further characterised by having stepped pistons with each piston and cylinder defining first and second working volumes, the first working volume of each piston of a pair feeding compressed fluid to the second working volume of the other piston of the pair.

14. A machine of claim 11 being a reciprocating piston internal combustion engine.

* * * * *

UNITED STATES PATENT AND TRADEMARK OFFICE

CERTIFICATE OF CORRECTION

PATENT NO. : 5,279,209

DATED : January 18, 1994

INVENTOR(S) : Alfred Rickard Mayne

It is certified that error appears in the above-indentified patent and that said Letters Patent is hereby corrected as shown below:

The title page showing the illustrative figure should be deleted to be replaced with the attached title page.

Signed and Sealed this

Thirteenth Day of December, 1994

*Attest:*

Bruce Lehman

BRUCE LEHMAN

*Attesting Officer*

*Commissioner of Patents and Trademarks*

United States Patent [19]

Mayne

[11] Patent Number: 5,279,209

[45] Date of Patent: Jan. 18, 1994

[54] ROTARY MACHINE

[75] Inventor: Alfred R. Mayne, Parkwood, Australia

[73] Assignee: Split Cycle Technology, Ltd., Queensland, Australia

[21] Appl. No.: 946,457

[22] PCT Filed: May 22, 1991

[86] PCT No.: PCT/AU91/00224

§ 371 Date: Nov. 13, 1992

§ 102(e) Date: Nov. 13, 1992

[87] PCT Pub. No.: WO91/18188

PCT Pub. Date: Nov. 28, 1991

[30] Foreign Application Priority Data

May 22, 1990 [AU] Australia ..... PK 0267

[51] Int. Cl.[5] ..... F01B 9/00

[52] U.S. Cl. ..... 92/140; 74/129; 74/143; 475/14; 123/197.1; 92/148

[58] Field of Search ..... 92/72, 140, 148; 74/128. 129 X. 142. 143 X: 475/14 X: 123/197.1 X

[56] References Cited

U.S. PATENT DOCUMENTS

| | | | |
|---|---|---|---|
| 1,777,179 | 9/1930 | Perlman | 123/197.1 |
| 2,417,649 | 3/1947 | Johansen et al. | 123/197.1 |
| 2,779,201 | 1/1957 | Hurley | 74/129 |
| 3,433,172 | 3/1969 | Sola | 92/140 |

FOREIGN PATENT DOCUMENTS

| | | | |
|---|---|---|---|
| 3-189447 | 8/1991 | Japan | 74/129 |

*Primary Examiner*—Thomas E. Denion

*Attorney, Agent, or Firm*—Brumbaugh, Graves, Donohue & Raymond

[57] ABSTRACT

A machine that converts between reciprocating motion of a piston and rotary motion of a shaft. The shaft rotates an integral web that carries a number of lobe wheels spaced evenly about a pitch circle centered on the shaft. The lobe wheels are planetary driven by pinions and a fixed ring gear. The lobe wheels are somewhat star shaped with radially extending lobes which push followers outwardly, then release them inwardly, as the lobe wheels orbit past and below the follower. The follower is connected by a lever and a pair of connecting rods and to the piston.

14 Claims, 6 Drawing Sheets

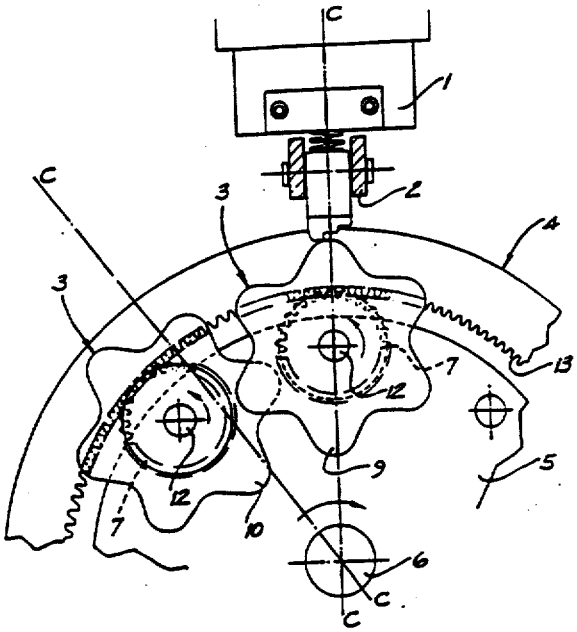

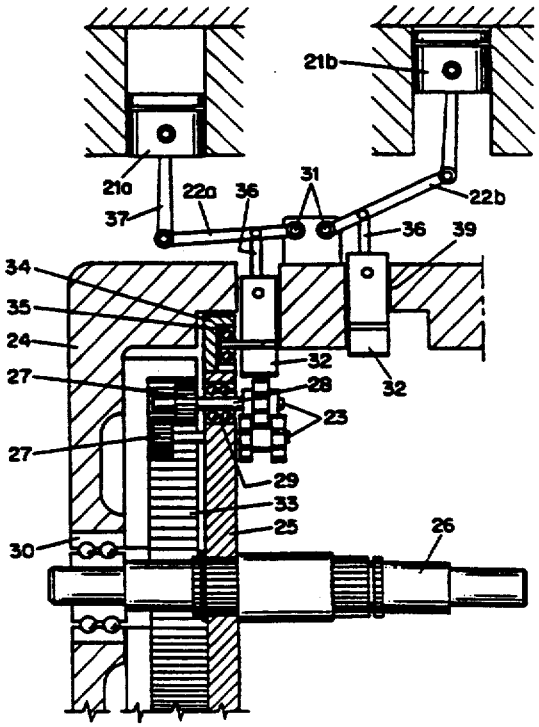

UNITED STATES PATENT AND TRADEMARK OFFICE

CERTIFICATE OF CORRECTION

PATENT NO. : 5,279,209

DATED : January 18, 1994

INVENTOR(S) :

Alfred Rickard Mayne

It is certified that error appears in the above-indentified patent and that said Letters Patent is hereby corrected as shown below:

Column 2, line 44, replace "asyncronously" with --asynchronously--.
Column 3, line 8, delete "30".

In the drawings, repalce Figure 2 with the following:

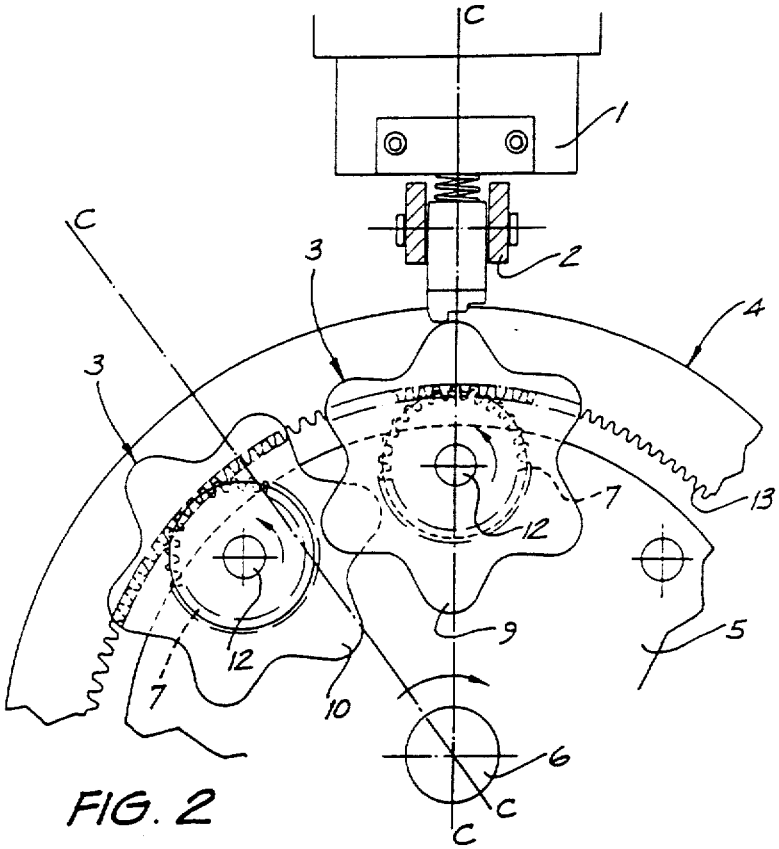

FIG. 2